US008822398B2

(12) United States Patent
Charles

(10) Patent No.: US 8,822,398 B2
(45) Date of Patent: Sep. 2, 2014

(54) DETERGENT COMPOSITIONS COMPRISING A POLYDIMETHYLSILOXANE ON SODIUM ACETATE FOAM CONTROL AGENT AND METHODS OF MAKING

(76) Inventor: Jonathan D. Charles, Melrose, MA (US)

( * ) Notice: Subject to any disclaimer, the term of this patent is extended or adjusted under 35 U.S.C. 154(b) by 0 days.

(21) Appl. No.: 13/315,364

(22) Filed: Dec. 9, 2011

(65) Prior Publication Data

US 2012/0149627 A1 Jun. 14, 2012

Related U.S. Application Data

(60) Provisional application No. 61/421,831, filed on Dec. 10, 2010.

(51) Int. Cl.

| | |
|---|---|
| ***C11D 9/36*** | (2006.01) |
| ***C11D 3/37*** | (2006.01) |
| ***C11D 3/00*** | (2006.01) |
| ***C11D 1/83*** | (2006.01) |
| ***C11D 3/20*** | (2006.01) |

(52) U.S. Cl.

CPC *C11D 1/83* (2013.01); *C11D 3/373* (2013.01); *C11D 3/0026* (2013.01); *C11D 3/2079* (2013.01)

USPC ..... 510/222; 510/220; 510/228; 510/276; 510/317; 510/347; 510/343; 510/466

(58) Field of Classification Search

USPC ..... 510/220, 222, 228, 276, 317, 347, 343, 510/466

See application file for complete search history.

(56) References Cited

U.S. PATENT DOCUMENTS

| | | | | |
|---|---|---|---|---|
| 3,933,672 | A | 1/1976 | Bartolotta et al. | |
| 4,075,118 | A | 2/1978 | Gault et al. | |
| 5,759,980 | A | 6/1998 | Russo et al. | |
| 5,972,869 | A | 10/1999 | Cao et al. | |
| 6,878,680 | B2 * | 4/2005 | Kitko et al. | 510/311 |
| 7,018,977 | B2 | 3/2006 | Martens et al. | |
| 7,033,987 | B2 | 4/2006 | Depoot et al. | |
| 7,179,777 | B2 | 2/2007 | Blokzijl et al. | |
| 2001/0009896 | A1 | 7/2001 | Hoogland et al. | |
| 2003/0069162 | A1 | 4/2003 | William Appel et al. | |
| 2003/0100472 | A1 * | 5/2003 | Wierenga | 510/446 |
| 2008/0032910 | A1 * | 2/2008 | Smets et al. | 510/342 |
| 2011/0081392 | A1 * | 4/2011 | De Arruda et al. | 424/401 |

OTHER PUBLICATIONS

Denkov, Nikolai D.; "Mechanisms of Foam Destruction by Oil-Based Antifoams", Langmuir 2004, 20, 9463-9505, 2004 American Chemical Society, Published on Web Jun. 24, 2004.

* cited by examiner

*Primary Examiner* — Charles Boyer
(74) *Attorney, Agent, or Firm* — Eckert Seamans Cherin & Mellott, LLC; Carol A. Marmo

(57) ABSTRACT

The present invention relates to a detergent composition for dish washing and clothes washing machines which includes an anionic surfactant, a non-ionic surfactant, and a foam control agent which includes polydimethylsiloxane, sodium acetate, and mixtures thereof. The detergent composition is in a dry form and is capable to reduce or preclude the formation of suds when combined with water.

10 Claims, No Drawings

DETERGENT COMPOSITIONS COMPRISING A POLYDIMETHYLSILOXANE ON SODIUM ACETATE FOAM CONTROL AGENT AND METHODS OF MAKING

CROSS-REFERENCE TO RELATED APPLICATION

The present application is a traditional application of U.S. Provisional Patent Application 61/421,831, filed Dec. 10, 2010, and entitled "DETERGENT COMPOSITIONS AND METHODS OF MAKING" which is herein incorporated by reference in its entirety.

FIELD OF THE INVENTION

The invention relates to detergent compositions and methods of making the same. In particular, the detergent compositions are in a dry form and are capable to reduce or preclude the formation of suds when combined with water. The detergent compositions are especially useful in dish and clothes washing machines.

BACKGROUND

Various detergent compositions and their ingredients, such as surfactants, are well known in the art. For example, early synthetic surfactants for use in detergents included anionic surfactants because they are excellent at dirt removal. However, anionic surfactants produce a high suds level. Depending on where and how the anionic surfactants are used, the high suds level may or may not be problematic. For example, when anionic-containing detergents were used in the wringer washers of the 1940s, the high suds level was not a problem. The suds floated on top, away from the cleaning zone in these top load washers and therefore, did not hinder the cleaning process. However, in the 1950s and 1960s when tumbler washers (including lower water use washers) were introduced, there were disadvantages associated with the high suds level produced by the anionic surfantant-containing detergents. The suds hindered the mechanical action in the washer and resulted in reduced cleaning. Thus, non-ionic surfactants were then introduced for use in detergent compositions. The non-ionic surfactants were effective on grease and oily stains and produced a low suds level. The low suds level was considered an advantage for the new automatic washing machines.

In the art, there has been considerable interest generated by the synergistic relationship between non-ionic and anionic surfactants and saturated fat combinations. Such combinations can be effective to produce a lower suds level while boosting cleaning power. See, for example, U.S. Pat. No. 2,954,347.

Today, various known detergent formulations are no longer desirable due to several current factors in the marketplace. These factors include (i) the introduction of modern high efficiency ("HE") washing machines, such as dish washing and clothes washing machines, which have extremely low water usages that are mandated by the government and (ii) phosphate free detergent formulations. Thus, for example, the current washing machines have little or no tolerance for the production of suds in the cleaning cycle. However, producing a detergent with a low or zero suds profile has proven to be difficult by detergent manufacturers.

In the art, there appears to be a shift away from the use of non-ionic surfactants combined with anionic surfactants. Newer formulations, such as HE detergents which are specifically formulated for use with HE dish washing and clothes washing machines, may contain an anionic surfactant only. Some of these HE detergents may result in a higher suds level than some previous detergents which used a non-ionic surfactant combined with an anionic surfactant. Thus, these HE detergents can produce a significant amount of suds (e.g., foam-up) hindering the mechanical action in the washing machine and causing reduced cleaning performance. In addition, a high suds profile can also cause poor rinsing and result in residue build up with the new lower water levels in the wash and rinse cycles of washing machines. Some washing machine manufacturers have incorporated mechanical and software devices, with protocols not controlled by the user, to monitor suds levels in order to handle the problem of significant suds/foam profiles resulting from newer detergents. When these devices are activated and an over-suds condition is detected, resolution of this condition may not be simple and in some instances, may even require a repairman to resolve and/or reset.

Newer detergent formulations which include a substantial amount of anionic surfactants may also include antifoam agents to control the suds profile. These antifoam agents can include oils of silicone or emulsions of silicone. These antifoam agents do not easily disperse or dissolve in water, and they do not rinse out as easily as water-soluble ingredients. Further, antifoam agents are typically in the form of a liquid at room temperature and therefore, the resulting detergents containing these agents are also in the form of a liquid.

It is desired in the art to formulate a detergent composition that exhibits good cleaning performance for a broad spectrum of soils and has little or no suds profile such that when used, the detergent composition reduces or precludes the production of suds. Moreover, it is also desired that the detergent composition be in the form of a powder.

SUMMARY OF THE INVENTION

An aspect of the invention provides a detergent composition including an anionic surfactant, a non-ionic surfactant, and a foam control agent. The foam control agent includes polydimethylsiloxane, sodium acetate and mixtures thereof. The detergent composition is in a dry form.

The anionic surfactant can be present in an amount of from about 1% to about 30% by weight based on weight of the composition.

The non-ionic surfactant can be present in an amount of from about 1% to about 30% by weight based on weight of the composition.

The foam control agent can be present in an amount of from about 1% to about 20% by weight based on weight of the composition.

The polydimethylsiloxane can be selected from the group consisting of a co-polymer of polydimethylsiloxane and a polymer of polydimethylsiloxane.

The non-ionic surfactant can include a carbon chain from $C_{10}$ to $C_{18}$.

The detergent composition can be in a form of powder, granules or tablet.

The detergent composition can be capable to reduce or preclude formation of suds when said detergent composition is combined with water.

The detergent composition can have a suds profile of zero.

The foam control agent can include polydimethylsiloxane and sodium acetate. This foam control agent can be in a dry form.

The amount of the foam control agent can be varied to adjust a suds profile of the detergent composition.

The detergent composition can further include at least one enzyme.

In another aspect, the invention provides a method of preparing a detergent composition. The method includes combining an anionic surfactant, a non-ionic surfactant and a foam control agent to produce the detergent composition in a dry form. The foam control agent includes polydimethylsiloxane, sodium acetate and mixtures thereof.

The polydimethylsiloxane can be selected from the group consisting of a co-polymer of polydimethylsiloxane and a polymer of polydimethylsiloxane.

The detergent composition can be capable to reduce or preclude formation of suds.

The detergent composition can be prepared in the absence of phosphates.

The migration of the foam control agent with the anionic surfactant and non-ionic surfactant can be reduced to increase storage stability of the detergent composition.

The foam control agent can include polydimethylsiloxane and sodium acetate. This foam control agent can be in a dry form.

DETAILED DESCRIPTION OF THE INVENTION

The invention relates to detergent compositions and methods of making the same. The detergent compositions are in a dry form, such as but not limited to powder, granules or tablet. Further, the detergent compositions are effective to clean a variety of soils in various applications. For example, the detergent compositions can be used to clean soiled clothes and dishes. As used herein, it is understood that the term "dishes" is meant to encompass stemware, flatware and like articles which are typically cleaned in a dish washing machine using a detergent. The detergent compositions are typically used to wash clothes and dishes in automatic clothes and dish washing machines. Thus, the detergent composition is added to a washing machine and during the washing process or cycle, the detergent composition is combined with water. In general, it is typical for the combination of a detergent composition with water to result in the formation of suds or foam. The level or profile of the suds can depend on the specific detergent used and the composition of the detergent.

In certain embodiments of the invention, the detergent composition can have a low or no suds profile such that when used, for example, in a washing machine to clean clothes and dishes, the detergent produces little or no suds. The composition of the detergent (e.g., the ingredients and their amounts) can be varied such that the suds profile is controllable or adjustable to satisfy the needs or desires of a user. For example, the detergent composition can be formulated to produce no suds or the detergent composition can be formulated to produce various amounts of suds greater than no suds. A user may feel more comfortable to observe a level of suds in the washing machine since suds are sometimes associated with the cleaning process, even though it is actually the wash liquor and the mechanical action of the washing machine that are effective to clean, for example, clothes and dishes. Thus, in certain embodiments, it may be desirable for the detergent composition of the present invention to produce a visible level of suds.

As compared to known detergent compositions, the detergent compositions in accordance with the invention are capable to reduce or preclude the production of suds in a washing machine. Further, without intending to be bound by any particular theory, it is believed that a lower suds profile results in a reduced micelle formation such that more surfactant remains dissolved in the wash liquor. This can lead to improved cleaning action and more vigorous mechanical action of the washing machine on the clothing. These attributes are desirable and believed to contribute to the cleaning and rinsing power of the detergent composition.

The detergent composition of the invention includes an anionic surfactant, a non-ionic surfactant and a foam control agent. The anionic surfactant can be selected from a wide variety of anionic surfactants known in the art including alkyl sulfonates, alkylethoxylate sulfonates, alkylbenzene sulfonates and mixtures thereof. In certain embodiments, linear alkylbenzene sulfonate (LAS) is used. A non-limiting example of a suitable commercial product is available under the trade name Nansa™ HS 901 from Huntsman. The amount of the anionic surfactant present in the detergent composition can vary widely and can depend on the specific compounds selected to formulate the composition. In one embodiment, the anionic surfactant is present in the detergent composition in an amount of from about 1% to about 30% by weight of the composition. In alternate embodiments, the anionic surfactant is present in the detergent composition in an amount of from about 5% to about 20% by weight of the composition or in an amount of about 7% to about 10% by weight of the composition. In certain embodiments, the anionic surfactant is in powder form.

The non-ionic surfactant can be selected from a wide variety of non-ionic surfactants known in the art including ethers of fatty alcohols. In certain embodiments, suitable non-ionic surfactants include high molecular weight non-ionic surfactants, such as but not limited to non-ionic surfactants having a carbon chain of $C_{10}$ or higher, $C_{16}$ or higher, from $C_{10}$ to $C_{18}$ or from $C_{16}$ to $C_{18}$. A non-limiting example of a suitable commercial product is available under the trade name Surfonic™ L24-9 from Huntsman. The amount of the non-ionic surfactant present in the detergent composition can vary widely and can depend on the specific compounds selected to formulate the composition. In one embodiment, the non-ionic surfactant is present in the detergent composition in an amount of from about 1% to about 30% by weight of the composition. In alternate embodiments, the non-ionic surfactant is present in the detergent composition in an amount of from about 5% to about 20% by weight of the composition or in an amount of about 7% to about 10% by weight of the composition. In certain embodiments, the non-ionic surfactant is in paste form.

The foam control agent is present in the detergent composition to control the suds profile when the detergent composition is combined with water, for example, in a dish washing machine or a clothes washing machine. Suitable foam control agents include those that are water soluble, dispersible and relatively quick to dissolve. Further, it is preferred to select a foam control agent which can be quickly rinsed. In certain embodiments, the foam control agent is silicone-based. Non-limiting examples of suitable foam control agents include polydimethylsiloxane, sodium acetate and mixtures thereof. The polydimethylsiloxane having formula $CH_3[Si(CH_3)_2O]nSi(CH_3)_3$ wherein n represents the number of repeating monomer units, includes co-polymers and/or polymers (e.g., homopolymers) of polydimethylsiloxane. Further, in certain embodiments, the foam control agent includes a combination or mixture of polydimethylsiloxane and sodium acetate. The amount of each of the polydimethylsiloxane and sodium acetate can vary. In certain embodiments, the polydimethylsiloxane can be present in an amount of greater than zero or greater than about 1% or from about 1% to about 15% or from about 5% to about 15% or from about 10% to about 15% by weight of the mixture. A non-limiting example of a suitable foam control agent is commercially available from Siovation Corporation under the trade name TPA-15. TPA-15 is described as a 15% active powder of a silicone-based anti-foam (i.e., polydimethylsiloxane) compound on sodium acetate.

The amount of the foam control agent present in the detergent composition can vary widely. The amount can depend on the specific compounds selected to formulate the composition. In certain embodiments, the amount of foam control agent used can depend on the level of suds or the suds profile that is desired when the detergent composition is combined with water in a washing process. Typically, the greater the amount of foam control agent, the lower the level of suds or suds profile and similarly, the lower the amount of foam control agent, the greater the level of suds or suds profile. Thus, the level of suds or suds profile can be controlled or adjusted. In certain embodiments, the foam control agent is present in the detergent composition in an amount of from about 1% to about 20% by weight. In alternate embodiments, the foam control agent is present in the detergent composition in an amount of from about 7% to about 15% by weight of the composition or in an amount of from about 10% to about 12% by weight of the composition. In certain embodiments, the foam control agent is in powder form.

Without, intending to be bound by any particular theory, it is believed that the selection and use of the foam control agent in accordance with certain embodiments of the invention, reduces migration of the components of the detergent. It is known in the art that migration can occur between the surfactant and silicone compound in a relatively short period of time, for example, in several days or less. As a result, the anti-foam control capability of the silicone compound may be reduced or eliminated. Since the foam control agent of the invention is effective to reduce or preclude migration in the detergent, the detergent can be stored for longer periods of time, such as for months, with substantially little or no loss in the anti-foam capability of the foam control agent, as compared to known detergents.

The pH of the detergent composition can vary. In certain embodiments, a dose of about 50 grams of detergent composition combined with about 4.5 gallons of clean water has a pH of from about 10.0 to about 11.5. When a dose of about 50 grams of detergent composition is combined with about 4.5 gallons of water with soiled clothes or dishes, instead of clean water only, the pH is about 9.5.

In certain embodiments, the detergent composition can include enzyme. Suitable enzymes can be selected from a wide variety of enzymes known in the art. Non-limiting examples of suitable commercial products include, but are not limited to, those known under the trade names Stainzyme™ 12T, Savinase™ 12T, Everlase™ and Lipclean™ 12T from Novozymes. The presence of enzyme in the detergent composition is optional. The enzyme can be effective to combat unique soils and for target cleaning. The amount of the enzyme present in the detergent composition can vary widely and can depend on the specific compounds selected to formulate the composition. In alternate embodiments, the enzyme can be present in the detergent composition in an amount of from about 1% to about 10% by weight of the composition or in an amount of from about 1% to about 5% by weight of the composition or in an amount of about 3% by weight of the composition. In certain embodiments, the enzyme is in granular form. Further, in certain embodiments, more than one enzyme can be present in the detergent composition. Each enzyme may be effective to provide a different property such as, bleaching, staining or the like. Further, enzyme can be used to boost cleaning power in the absence of phosphate and therefore, the detergent composition in accordance with the invention can exclude the presence of phosphate.

In certain embodiments, the amount of surfactant used in the detergent composition can depend on the amount of enzyme present and therefore, the amount of surfactant can be adjusted based on the amount of enzyme. In general, the amount of surfactant can be decreased as the amount of enzyme is increased. In certain embodiments, the amount of surfactant can be decreased by 20% by weight of the composition due to the presence of enzyme in an amount of from about 2% to about 4% by weight of the composition. Based on environmental factors, it is generally desirable to decrease the amount of surfactants used. A lower amount of surfactants can result in a more environmentally-friendly detergent composition.

In addition, the detergent composition of the present invention can include various other additives and adjuvants that are known in the art for use in such compositions. In certain embodiments, the detergent composition includes one or more of sodium salt, zeolite, fatty acid or salt of fatty acid, such as but not limited to, soap, sodium tallowate, sodium cocoate, and mixtures thereof.

The sodium salt can include sodium sulfate (i.e., sodium salt of sulfuric acid), sodium carbonate (i.e., sodium salt of carbonic acid) and mixtures thereof Sodium sulfate and sodium carbonate are commercially available. The amount of sodium salt present in the detergent composition can vary widely. In alternate embodiments, sodium salt can be present in the detergent composition in an amount of from about 40% to about 70% by weight of the composition or from about 59% to about 70% by weight of the composition or from about 49% to about 60% by weight of the composition or from about 49% to about 51% by weight of the composition. In certain embodiments, a mixture or combination of sodium sulfate and sodium carbonate is used. Further, in certain embodiments, the sodium sulfate and sodium carbonate are in powder form.

The zeolite may be selected based on its characteristics and properties. For example, one or more zeolites may be added to the detergent composition to provide corrosion protection, to neutralize acidic soils or as a water softener. Suitable zeolites can be selected from those known in the art, such as but not limited to, sodium silicate-polysilicate which is commercially available under the trade name Britesil C-20 from PQ Corporation and meta-silicate which is commercially available under the trade name MetsoPenta Bead 20 also from PQ Corporation. The amount of zeolite used in the detergent composition can vary widely. In alternate embodiments, zeolite can be present in the detergent composition in an amount of from about 5% to about 15% by weight of the composition or in an amount of from about 10% to about 12% by weight of the composition. In certain embodiments, the zeolite is in powder form.

Without intending to be bound by any particular theory, it is believed that the presence of soap, for example, when the detergent composition is used in a clothes washing machine, results in the clothes feeling softer to the touch and therefore, it may not be necessary to use a fabric softener. Suitable soaps can be selected from a wide variety of those known in the art. In certain embodiments, Ivory™ soap is used. The amount of soap present in the detergent composition can vary. In alternate embodiments, soap can be present in the detergent composition in an amount of from about 5% to about 15% by weight of the composition or in an amount of about 10% to about 12% by weight of the composition. In certain embodiments, the soap is in powder form.

Preparation of the detergent composition in accordance with the invention includes combining the anionic surfactant, non-ionic surfactant and foam control agent. Each of these ingredients may be in a dry form to produce the resultant detergent composition in a dry form. In certain embodiments, the non-ionic surfactant is in paste form. I is then heated to form a liquid and sprayed (using conventional techniques known in the art) on at least a portion of the dry ingredients in the composition. Optional ingredients are also combined therewith. Various conventional techniques and equipment (e.g., mixers, grinding mills and the like) can be used in producing the detergent composition. In certain embodiments, a mixer, such as but not limited to a known cement mixer, can be used to combine (e.g., and tumble) the ingredients to produce the dry form detergent composition.

In one embodiment, sodium carbonate, sodium sulfate, soap powder and zeolite are added to a mixer. Surfonic™ surfactant paste is then heated to a temperature of about 100° F. to obtain a substantially clear liquid. The Surfonic™ surfactant fluid is sprayed onto the mixture in the mixer as it tumbles. The other dry ingredients are then added including TPA-15 and LAS (linear alkyl benzene sulfonate) surfactant. The mixture is allowed to cool slightly and enzyme (e.g., granules) is added in a final tumbling step. Optionally, a liquid fragrance may be sprayed onto the mixture. The mixture is then allowed to set and dry. In certain embodiments, the mixture is heated to a temperature of 130° F. or lower because without intending to be bound by any particular theory, it is believed that heating beyond 130° F. may cause some of the ingredients to break down.

The detergent compositions in accordance with the invention exhibit various properties and characteristics that are advantages as compared to known compositions. The detergent compositions in accordance with the invention demonstrate at least one of the following properties and characteristics:

- a controllable suds profile that can be customized to user needs and desires;
- a foam control agent that is based on a dry, water soluble, silicone-containing powder;
- a dry powder formulation which can be transported and stored in unheated conditions;
- a dense compact powder, tablet, granule or any other such dry form as is convenient to the marketplace and for manufacturing costs;
- cleaning power in the absence of phosphates;
- a customized spectrum of enzymes designed to work in conjunction with the detergent by targeting various soils of starch, protein, and grease and oils;
- a dry silicone foam control agent which is water soluble and quickly dissolves in wash water, and precludes the use of oil- and emulsion-based agents;
- a dry silicone foam control agent which allows a dry powder profile with exceptional cleaning as compared to existing detergent formulations which due to the presence of oils and emulsions of silicone antifoams are formulated as liquids;
- a dry silicone foam control agent which reduces or precludes migration and therefore, increases the storage stability of the detergent and maintains a no suds profile following the storage period;
- a dry, water soluble, silicone foam control agent that easily rinses out and therefore, precludes the formation of residue in the washing machine (e.g., or on the clothing) that typically results from the use of oil-based silicone antifoam agents;
- the elimination of a need for mechanical and software suds control protocols in washing machines; and
- no suds produced during the entire wash cycle (from start through completion) of an automatic washing machine.

EXAMPLE

The following ingredients and their amounts (in weight percent based on total weight of the composition) were combined to form a detergent composition in accordance with certain embodiments of the invention: 36% sodium sulfate CAS 7757-82-6 (commercially obtained from Chemical Store Inc.), 15% Absorpta Plus Dense (commercially obtained from FMC), 7% Nansa HS901 (commercially obtained from Huntsman), 7% Surfonic L24-9 (commercially obtained from Huntsman), 5% Britesil C-20 (commercially obtained from PQ Corporation), 5% MetsoPenta Bead 20 (commercially obtained from PQ Corporation), 10% Ivory bar, 1% Savinase 12T (commercially obtained from Novozymes), 1% Lipoclean 12T (commercially obtained from Novozymes), 1% Stainzymer 12T (commercially obtained from Novozymes) and 12% TPA-15 (commercially obtained from Siovation). All of the ingredients were in dry form with the exception of Surfonic L24-9 which was in paste form.

The Absorpta Plus Dense, sodium sulfate CAS 7757-82-6, Ivory soap, Britesil C-20 and MetsoPenta Bead 20 (all in powder form) were added to a cement-like mixer. The Surfonic paste was heated to a temperature of about 100° F. to obtain a substantially clear liquid. The Surfonic fluid was then sprayed onto the mixture in the mixer as it tumbled. The TPA-15 and Nansa HS90 (both in powder form) were then added to the mixture. The mixture was allowed to tumble for about 20-30 minutes. The mixture was then allowed to cool slightly and the Savinase 12T, Lipclean 12T and Stainzyme 12T (all in granular form) were added in a final tumbling step. The mixture was then allowed to set and dry.

A portion of the resultant detergent composition was used in various makes and models of automatic clothes washing machines to wash soiled clothing. Each of the washing machines had a window in the door such that the contents therein could be observed during the entire cycle. It was found that no suds were visible/produced during the entire cycle (from start to completion). Further, a portion of the resultant detergent composition was stored in a container at room temperature for about 5 months. After 5 months, the detergent composition was used in an automatic clothes washing machine to wash soiled clothing and there were no suds visible/produced during the entire cycle (from start to completion).

While the invention has been described in terms of various specific embodiments, those skilled in the art will recognize that the invention can be practiced with modifications within the spirit and scope of the appended claims.

What is claimed is:

1. A detergent composition for use in a machine selected from the group consisting of dish washing machines and clothes washing machines, the detergent composition comprising:

- an anionic surfactant;
- a non-ionic surfactant; and
- a foam control agent which comprises a 15% active powder of polydimethylsiloxane on sodium acetate,
- wherein said detergent composition and said foam control agent are in a dry form, wherein an amount of the foam control agent is varied from about 1% to about 20% by weight based on weight of the detergent composition to adjust a suds profile of the detergent composition, and wherein when combined with water the detergent composition is effective to reduce or preclude the formation of suds.

2. The detergent composition of claim 1, wherein the anionic surfactant is present in an amount of from about 1% to about 30% by weight based on weight of the composition.

3. The detergent composition of claim 1, wherein the non-ionic surfactant is present in an amount of from about 1% to about 30% by weight based on weight of the composition.

4. The detergent composition of claim 1, wherein the non-ionic surfactant comprises a carbon chain from $C_{10}$ to $C_{18}$.

5. The detergent composition of claim 1, wherein said composition is in a form selected from the group consisting of powder, granules and tablet.

6. The detergent composition of claim 1, wherein said composition has a suds profile of zero.

7. The detergent composition of claim 1, further comprising at least one enzyme.

8. A method of preparing a detergent composition for use in a machine selected from the group consisting of dish washing machines and clothes washing machines, the method comprising:

obtaining a foam control agent which comprises a 15% active powder of polydimethylsiloxane on sodium acetate;

combining an anionic surfactant, a non-ionic surfactant and the foam control agent to produce said detergent composition in a dry form; and varying an amount of the foam control agent from about 1% to about 20% by weight based on weight of the detergent composition to adjust a suds profile of the detergent composition, wherein when combined with water the detergent composition is effective to reduce or preclude the formation of suds.

9. The method of claim 8, wherein the detergent composition is prepared in the absence of phosphates.

10. The method of claim 8, wherein migration of the foam control agent with the anionic surfactant and the non-ionic surfactant is reduced to increase storage stability of the detergent composition.

* * * * *